United States Patent [19]

Howe, Jr.

[11] 4,172,342

[45] Oct. 30, 1979

[54] METHOD OF FORMING A RING DOFFER

[75] Inventor: James W. Howe, Jr., Durham, N.C.

[73] Assignee: Gunter & Cooke, Inc., Durham, N.C.

[21] Appl. No.: 860,380

[22] Filed: Dec. 14, 1977

Related U.S. Application Data

[63] Continuation of Ser. No. 799,469, May 23, 1977, abandoned, which is a continuation of Ser. No. 457,973, Apr. 4, 1974, abandoned, which is a continuation-in-part of Ser. No. 414,995, Nov. 12, 1973, abandoned, which is a continuation of Ser. No. 392,127, Aug. 27, 1973, abandoned.

[51] Int. Cl.[2] ..... B24B 1/00

[52] U.S. Cl. ..... 51/281 R; 51/242

[58] Field of Search ..... 51/242, 243, 254, 281 R, 51/289 R, 95 LH, 48 HE

[56] References Cited

U.S. PATENT DOCUMENTS

| | | | |
|---|---|---|---|
| 406,537 | 7/1889 | Richmond | 51/242 |
| 426,545 | 4/1890 | Rankin | 51/242 |
| 2,849,844 | 9/1958 | Snape | 51/242 |
| 3,073,690 | 1/1963 | Hollis et al. | 51/49 X |

*Primary Examiner*—Nicholas P. Godici
*Assistant Examiner*—Robert P. Olszewski

[57] ABSTRACT

A ring doffer is provided for carded web splitting that prevents loading of the card cylinder during operation by employing a circumferential groove therein to effect the web splitting that is cut in a reversing helix pattern at a pitch exceeding the width of the groove.

4 Claims, 1 Drawing Figure

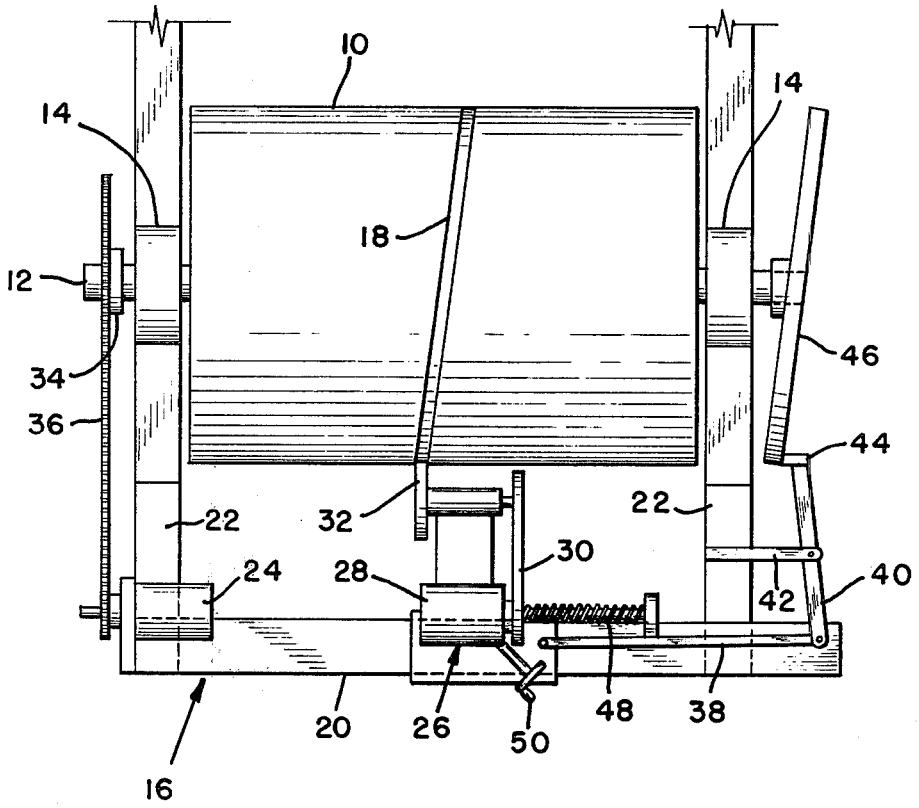
10
14
14
18
12
46
34
36
44
22
32
22
30
24
28
40
42
20
26
50
48
38
16

METHOD OF FORMING A RING DOFFER

CROSS-REFERENCES TO RELATED APPLICATIONS

This application is a continuation of, application Ser. No. 799,469 filed May 23, 1977, which is a continuation of application Ser. No. 457,973 filed Apr. 4, 1974, which is a continuation-in-part of application Ser. No. 414,995 filed Nov. 12, 1973, which is a continuation of application Ser. No. 392,127, all of which are now abandoned.

BACKGROUND OF THE INVENTION

In arranging for increased carding operation output it is often desirable to produce a heavy web which is split after carding to provide multiple slivers of the weight required. Thus, if 50 grain slivers are required, a web of 100 grain weight is produced and split medially after carding to allow formation of two slivers of the required weight.

The conventional means employed for such web splitting is a so-called ring doffer which is a card doffer roll having the clothing thereon disabled at a relatively narrow circumferential zone to effect the web splitting or division. The common practice heretofore followed in disabling the card clothing for this purpose has involved filling the clothing with a ring of metallic or plastic material at the circumferential zone where the splitting is to be done so that the doffer clothing will not strip at this zone and the doffer roll will accordingly strip separate webs at each side of this zone from the card cylinder for take-off and sliver formation. Such prior practice, however, has involved troublesome difficulty with loading of the card cylinder opposite the zone at which the doffer roll clothing has been disabled, and with the concerted efforts in recent years directed at increasing carding production rates such difficulty has been emphasized substantially.

The present invention eliminates this difficulty in an exceptionally advantageous manner.

SUMMARY OF THE INVENTION

Briefly described, the ring doffer of the present invention is characterized in its preferable form by a clothing cover having a disabled zone formed by cutting at least one circumferential groove therein to the root of the clothing teeth and following a reversing helix pattern at a pitch (i.e., angle of inclination) exceeding the groove width, preferably in the order of three times that width. The number of grooves cut in the clothing cover will depend on the number of parts into which it is desired to split a carded web being handled. Usually the need will be for splitting the web medially into parts, and for this purpose the groove is located symmetrically in relation to the axial midpoint of the doffer.

If desired, the cut groove or grooves can be filled with a metallic or plastic material comparable to the previously noted prior practice, or such a material can be filled in at a reversing helical zone defined between temporary taping applied at the clothing cover surface, or a soft plastic material or the like penetrable by the clothing elements can be taped into place in the reversing helix pattern to form the disabled zone, although no such aproximation of the indicated prior practice has been found necessary.

Helical arrangement of the web splitting groove in the foregoing manner has the effect of maintaining the card cylinder clear of loading substantially as if the doffer clothing were continuous, which at the same time allowing sliver of excellent evenness and quality to be produced from the split web portions. The preferable ring doffer arrangement, as well as the method and means by which it is formed, are described further below in connection with the accompanying drawings.

DESCRIPTION OF THE DRAWINGS

The single FIGURE is schematic representation in plan of an arrangement of means for forming a ring doffer in accordance with the present invention.

DETAILED DESCRIPTION OF THE INVENTION

In the drawing, a doffer roll is indicated by the reference numeral 10 rotatably supported at journal portions of an axial shaft 12 in pillow block bearings or the like 14 on a frame structure 16. The frame structure 16 may be one specially provided for use in forming ring doffers according to the present invention, or it may be a conventional card frame having the doffer roll 10 in place thereon, in which case the doffer drive, as well as the front girt and calendar rolls and other related operating structure thereat is removed to allow temporary installation of the means employed for cutting a web splitting groove in the doffer roll 10 as indicated at 18.

In either case, with the doffer roll 10 securely supported but free for rotation, a sub-frame mount comprising a cross bar 20 fitted with two attaching legs 22 is fixed in place across the front end of frame structure 16 (i.e., at the bottom as seen in the drawing) to carry a drive motor 24 for rotating the doffer roll and a grinding unit 26 including a drive motor 28 from which a belt connection or the like at 30 reaches to a spindle on which a grinding wheel is carried at 32. The doffer roll motor 24 is preferably a 60 RPM, 110 V, gear head type, and one end of the doffer roll shaft 12 is temporarily fitted with a sprocket 34 from which a chain connection 36 is extended to motor 24 as shown.

The grinding unit 26 is slidably carried on the sub-frame cross bar 20 and has a pivotally connected linking rod 38 extending therefrom to one end of a follower arm 40 that is supported intermediate its length on a fulcrum arm 42 extending from the adjacent sub-frame attaching leg 22. At its other end, the follower arm 40 carries a cam follower roll 44 for riding the opposing face of a cam wheel 46 temporarily installed at the other end of doffer roll shaft 12, and a tension spring 48 is adjustably anchored on sub-frame cross bar 20 and fixed to grinding unit 26 so as to provide a basis by which follower roll 44 is maintained in riding contact with cam wheel 46. Grinding unit 26 is additionally provided with a handwheel 50 operating a feed means (not shown) by which cutting depth of grinding wheel 32 is controlled.

The foregoing arrangement is employed for cutting a web splitting groove 18 in doffer roll 10 by first removing the tension from bias spring 48 an sliding the grinding unit 26 on sub-frame cross bar 20 to position grinding wheel 32 at the mid-point of the helical pattern in which groove 18 is to be cut. Thus, if only a medially located groove 18 is to be provided as illustrated, the grinding wheel 32 is set at the axial midpoint of doffer roll 10. Then the installed cam wheel 46 is set at a centerline position, with which it should be marked, in contact with cam follower roll 44, after which cam wheel 46 is fixed on doffer roll shaft 12 at this setting and biasing tension is restored at spring 48. A check should be made at this stage to be sure that the restored bias of spring 48 has not disturbed the proper location of grinding wheel 32 in relation to doffer roll 10, and an appropriate resetting effected if it has.

When the foregoing set-up has been checked out satisfactorily, the doffer roll and grinding unit drive motors 24 and 28 are both started to commence the groove cutting operation. For either 27" or 12" doffer rolls 10 a 6" grinding wheel 32 is suitable at a ¼" width. A wheel of the "saw-gumming" type provides good groove cutting action, although any other reasonably comparable abrasive wheel might be used as well. A ⅓ HP, 1725 RPM, 110 V drive motor 28 is advantageously provided. The clothing cover on doffer roll 10, which is normally formed of metallic wire according to current practice, is cut to the root of the clothing teeth by feeding the grinding wheel 32 to this depth from handwheel 50, and as the cam wheel and follower system provided will result in reciprocating the grinding unit 26 as doffer roll 10 is rotated the groove cutting will follow the reversing helical pattern illustrated. When a ¼" grinding wheel is used to cut a groove 18 of essentially the same width it has been found that a helical groove pattern of ¾" pitch provides excellent protection against cylinder loading in accordance with the present invention while producing split web portions of usual evenness and quality.

The present invention has been described in detail above for purposes of illustration only and is not intended to be limited by this description or otherwise to exclude any variation or equivalent form or procedure that would be apparent from, or reasonably suggested by, the foregoing disclosure to the skill of the art.

I claim:

1. The method of forming a ring doffer for affecting web splitting in a reversing helix pattern to maintain the card cylinder clear of loading to provide a sliver of excellent evenness and quality which comprises supporting a clothed doffer for rotation, causing the supported doffer to rotate, applying groove cutting means to the rotating doffer, reciprocating the groove cutting means parallel to the doffer axis at a throw at least equal to the width of the groove being cut, cutting said groove circumferentially to the depth of the doffer clothing teeth thereby removing said teeth to form a disabled zone ring on the doffer.

2. The method of forming a ring doffer as defined in claim 1 wherein the throw at which said groove cutting means is reciprocated is in the order of three times the width of the groove being cut.

3. A method of forming a ring doffer as claimed in claim 1 and including applying said groove cutting means to the axial midpoint of the clothed doffer.

4. The method of forming a ring doffer as claimed in claim 1 and including setting a groove cutting means having a cam wheel and resilient means at the axial midpoint of the clothed doffer, setting the cam wheel of the groove cutting means at the center position, biasing the tension of the resilient member of the cutting means, simultaneously rotating the clothed doffer and cutting means, and adjusting the cutting depth of the cutting means.

* * * * *